US006171099B1

(12) United States Patent
Lin

(10) Patent No.: US 6,171,099 B1
(45) Date of Patent: Jan. 9, 2001

(54) SWITCH SAFETY DEVICE FOR A GAS TORCH

(76) Inventor: Arlo H. T. Lin, No. 5, Lane 25, Da-Tung Rd., Wu-Feng Hsiang, Taichung Hsien (TW)

( * ) Notice: Under 35 U.S.C. 154(b), the term of this patent shall be extended for 0 days.

(21) Appl. No.: 09/523,718

(22) Filed: Mar. 13, 2000

(51) Int. Cl.[7] ..... F23D 11/36
(52) U.S. Cl. ..... 431/153; 431/255; 431/344
(58) Field of Search ..... 431/153, 277, 431/255, 344, 345, 256, 254, 143, 266; 126/406, 411, 413

(56) References Cited

U.S. PATENT DOCUMENTS 5,800,155 * 9/1998 Miyanaga ..... 431/153
5,839,892 * 11/1998 Hwang ..... 431/153
5,885,069 * 3/1999 Rogelet ..... 431/153
5,885,070 * 3/1999 Lin ..... 431/255
5,921,768 * 7/1999 Joncg ..... 431/255

* cited by examiner

*Primary Examiner*—James C. Yeung
(74) *Attorney, Agent, or Firm*—Charles E. Baxley

(57) ABSTRACT

A safety device for a gas torch includes a frame movably inserted into a notch in a top of a handle of the gas torch and the ignition device of the torque is received in the frame. A pressing member is slidably connected to the frame and connected to lever of a valve for releasing gas from a tank. A front end of the pressing member is inserted in the notch of the handle to prevent the pressing member from being unintentionally pushed. The front end of the pressing member has to be pulled out from the notch before it is pushed.

4 Claims, 6 Drawing Sheets

SWITCH SAFETY DEVICE FOR A GAS TORCH

FIELD OF THE INVENTION

The present invention relates to a switch safety device for a gas torch. The pressing member of the switch has to be pulled before being pressed so as to prevent from unintentionally operation.

BACKGROUND OF THE INVENTION

A conventional gas torch generally includes a handle with a switch connected to a top of the handle and a nozzle connected from a front end of the handle. A tank or the like is received in the handle for liquid gas received in the tank. An ignition device and a release lever for releasing gas from the tank are respectively connected to the switch so that when pushing a pressing member of the switch, the ignition device is actuated to generate a spark and the gas is release and blows out from the nuzzle. Although the switch is simple and easily to operate, there is no safety device to avoid unintentionally operation of the switch. In other words, anyone including a kid could operate the switch to let the gas be ignited and blow.

The present invention intends to provide a safety device for a gas torch and the pressing member of the switch has to be pulled toward the user then the pressing member can be pushed downward to ignite the ignition device.

SUMMARY OF THE INVENTION

In accordance with one aspect of the present invention, there is provided a gas torch and comprising a handle having a nozzle extending from a front surface of the handle and a tank and a valve device are received in the handle. A notch is defined in a rear top corner of the handle and has at least one shoulder extending inward from one of two inside of the notch. A frame is movably inserted into the notch and mounted to the ignition device. The frame has two side walls with a rear wall connected between the two side walls, a top board is mounted to a top of the frame. The lever of the valve device is connected to the frame. A pressing member is slidably engaged with the top board and a front end of the pressing member is slidably inserted in the notch of the handle. One of two sides of the pressing member is slidably supported on the at least one shoulder.

The object of the present invention is to provide safety device for a gas torch and the pressing member of the safety device cannot pushed except the front end of the pressing member is moved from a notch in the handle of the gas torch.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
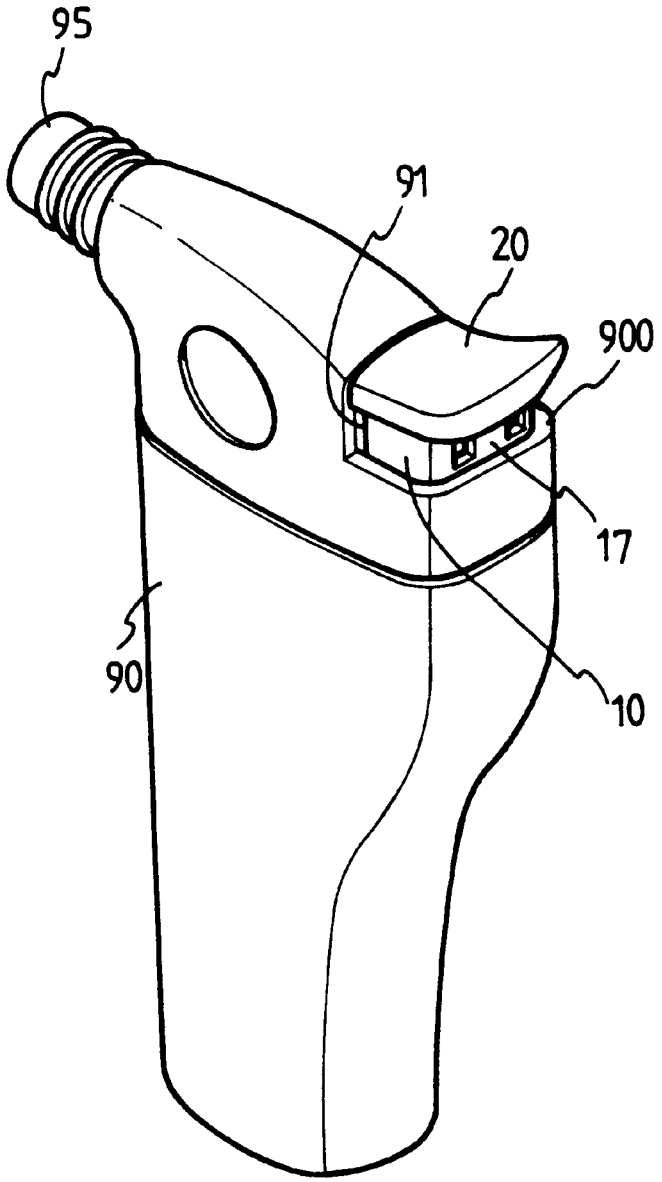
FIG. 1 is a perspective view to show a gas torch having a the safety device of the present invention.
Figure 2:
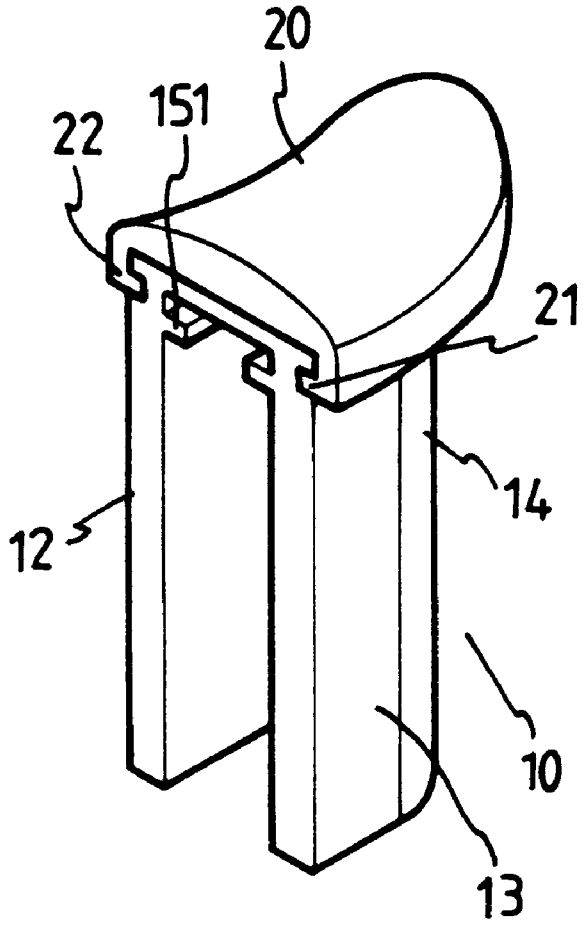
FIG. 2 is a perspective view to show the safety device of the present invention.
Figure 3:
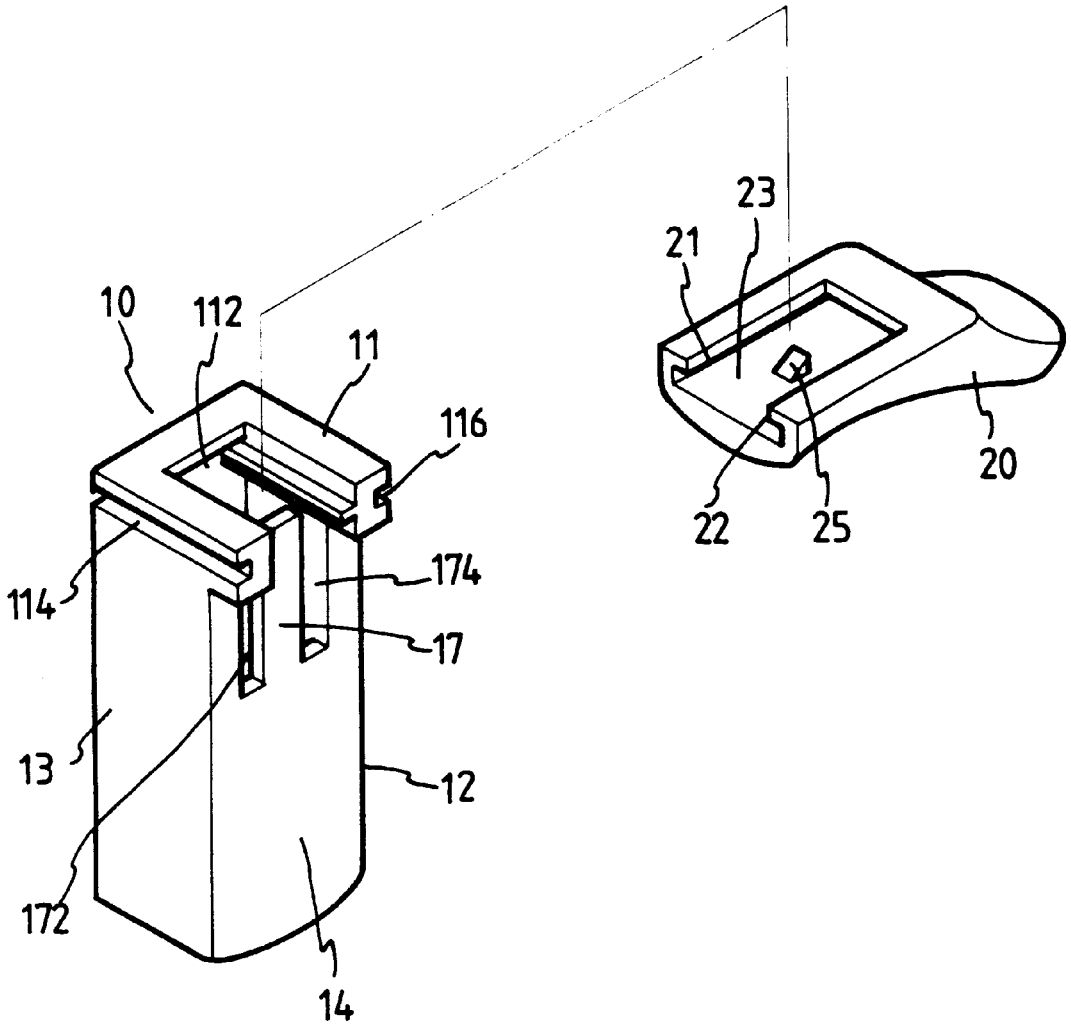
FIG. 3 is an exploded view to show the safety device of the present invention.
Figure 4:
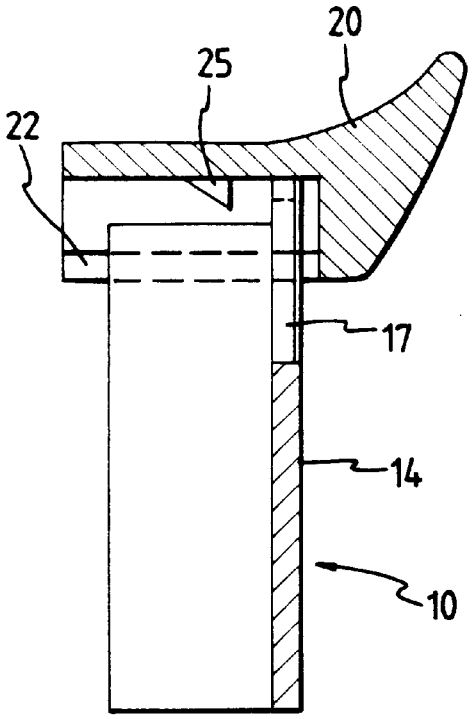
FIG. 4 is a side elevational view, partly in section, of the safety device of the present invention.
Figure 5:
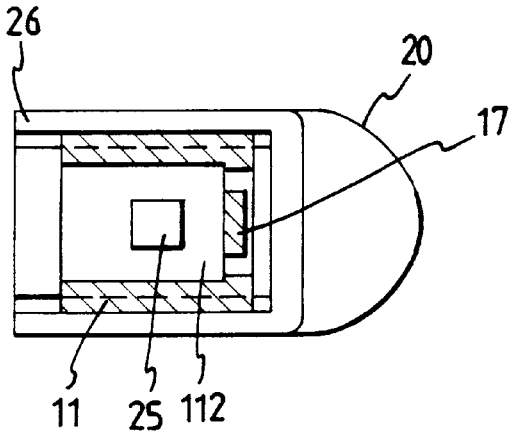
FIG. 5 is a top view, partly in section, to show the safety device of the present invention.
Figure 6:
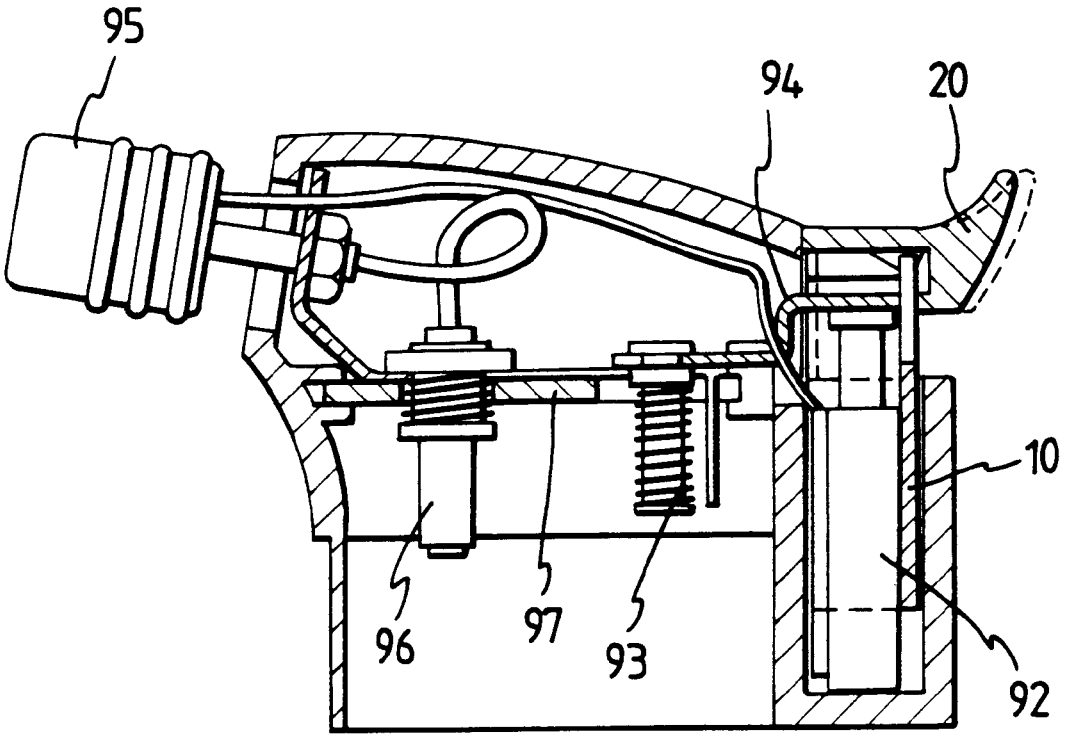
FIG. 6 is a side elevational view, partly in section, of the safety device of the present invention and the parts of the gas torch.

Referring to FIGS. 1 to 6, a gas torch comprises a handle 90 which has a nozzle 95 extending from a front surface thereof and a support board 97 is located in the handle 90. A tank 96 for receiving liquid gas is supported on the support board 97 and connected to the nozzle 95 by a pipe. A valve device 93 is supported on the support board 97 and has a lever 94 extends therefrom. When the lever 94 is moved downward, the valve device 93 is actuated and gas is released from the tank 96. An ignition device 92 is received in the handle 90 and can generate a spark in the nozzle 95 to ignite the gas. A notch 900 is defined in a rear top corner of the handle 90 and has at least one shoulder 91 extending inward from one of two inside defining the notch 900.

A tubular frame 10 is movably inserted into the notch 900 and mounted to the ignition device 92. The frame 10 has two side walls 12, 13 and a rear wall 14 is connected between the two side walls 12, 13. A top board 11 is mounted to a top of the frame 10 and having an aperture 112 which communicates with an interior of the frame 10. Two slots 172, 174 are defined in a top of the rear wall 14 to define a flexible plate 17 between the two slots 172, 174. Two grooves 114, 116 are respectively defined in two sides of the top board 11, and two flanges 151 respectively extend from two respective insides of the two side walls 12, 13. The lever 94 of the valve device 93 is supported on the two flanges 151 and engaged between the two flanges 151 and the top board 11.

A pressing member 20 is slidably engaged with the top board 11 and has two ridges 21, 22 respectively extending inward from two sides of an underside of the pressing member 20. The two ridges 21, 22 are slidably received in the two grooves 114, 116 in the top board 11 so that the pressing member 20 can be slid corresponding to the top board 11. A front end of the pressing member 20 is slidably inserted in the notch 900 of the handle 90 and one of the two ridges 21, 22 of the pressing member 20 is slidably supported on the at least one shoulder 91, so that the pressing member 20 cannot be pushed when the front end of the pressing member 20 is inserted in the notch 900. A retractable rod of the ignition device 92 is engaged with to the pressing member 20 via the aperture 112 of the top board 11 so that when the pressing member 20 is pushed downward, the rod is pushed into the ignition device 92 and generates a spark in the nozzle 95. A protrusion 25 extends from the underside of the pressing member 20.

Figure 7:
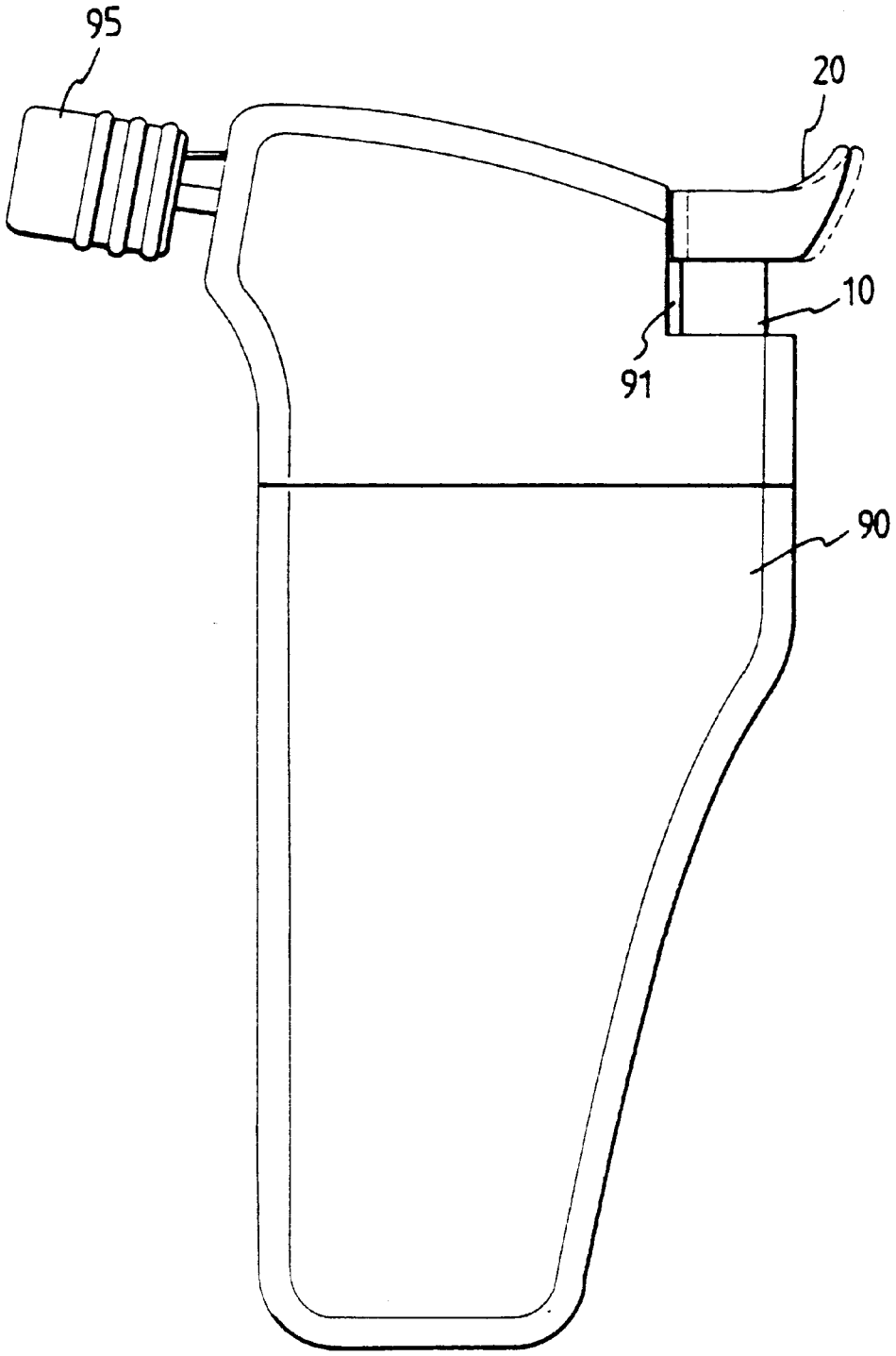
FIG. 7 is a side view to show the actions to operate the safety device of the present invention.

As shown in FIG. 7, when in use, the user has to pull the pressing member 20 away from the nozzle 95 and let the ridges 21, 22 disengage from the at least one shoulder 91. Then the user can push the pressing member 20 to push the lever 94 of the valve device 93 and the rod of the ignition device 92 downward to ignite the gas blowing from the nozzle 95. When pulling the pressing member 20, the protrusion 25 pushes the flexible plate 17 and when releasing the pressing member 20, the pressing member 20 returns by the force of the flexible plate 17.

While we have shown and described various embodiments in accordance with the present invention, it should be clear to those skilled in the art that further embodiments may be made without departing from the scope and spirit of the present invention.

What is claimed is:

1. A gas torch comprising:

a handle having a nozzle extending from a front surface of said handle, a support board in said handle, a tank supported on said support board and connected to said nozzle, a valve device supported on said support board and having a lever extending therefrom, an ignition device received in said handle, a notch defined in a rear top corner of said handle and having at least one shoulder extending inward from one of two inside of said notch;

a frame movably inserted into said notch and mounted to said ignition device, said frame having two side walls and a rear wall connected between said two side walls, a top board mounted to a top of said frame and having an aperture which communicates with an interior of said frame, said lever of said valve device connected to said frame, two slots defined in a top of said rear wall to define a flexible plate between said two slots, and a pressing member slidably engaged with said top board and a front end of said pressing member slidably inserted in said notch of said handle, said ignition device engaged with to said pressing member via said aperture of said top board, one of two sides of said pressing member slidably supported on said at least one shoulder, a protrusion extending from an underside of said pressing member, said flexible plate being pushed by said protrusion when said pressing member is pulled.

2. The gas torch as claimed in claim 1 further comprising two grooves respectively defined in two sides of said top board said pressing member having two ridges respectively extending inward from two sides of an underside of said pressing member, said two ridges slidably received in said two grooves in said top board.

3. The gas torch as claimed in claim 2, wherein one of said two ridges is slidably supported on said at least one shoulder.

4. The gas torch as claimed in claim 1 further comprising two flanges respectively extending from two respective insides of said two side walls, said lever of said valve device supported on said two flanges and engaged between said two flanges and said top board.

* * * * *